US006488548B1

(12) United States Patent
Tomasino

(10) Patent No.: US 6,488,548 B1
(45) Date of Patent: Dec. 3, 2002

(54) ELECTRICAL END TERMINAL FOR USE WITH NO TOOL CONNECTOR

(75) Inventor: René Tomasino, Doniphar, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

(21) Appl. No.: 09/550,710

(22) Filed: Apr. 17, 2000

Related U.S. Application Data

(60) Provisional application No. 60/131,343, filed on Apr. 28, 1999.

(51) Int. Cl.[7] ..... H01R 11/09; H01R 4/38

(52) U.S. Cl. ..... 439/784; 439/805

(58) Field of Search ..... 439/784, 805, 439/428, 502, 727, 797

(56) References Cited

U.S. PATENT DOCUMENTS

| | | | | | |
|---|---|---|---|---|---|
| 1,790,101 | A | * | 1/1931 | Kohloff | 439/502 |
| 4,273,409 | A | * | 6/1981 | Blanche et al. | 439/736 |
| 4,813,884 | A | * | 3/1989 | Brubaker | 439/389 |
| 5,194,013 | A | * | 3/1993 | Propp | 439/265 |
| 5,975,939 | A | | 11/1999 | Market | 439/415 |
| 6,126,491 | A | * | 10/2000 | McCarthy | 439/695 |

* cited by examiner

*Primary Examiner*—Tulsidas Patel
*Assistant Examiner*—Chandrika Prasad
(74) *Attorney, Agent, or Firm*—Jim Zegeer

(57) ABSTRACT

A conductive metal end terminal for use with no tool electrical connector. The end terminal has a central shank portion shank portion having a pair of ends, a splayable coupling portion on one of the ends and a terminal end on the other of the ends. One or more barbs may be on the shank portion, and the splayable end may have one or more claw formations thereon.

10 Claims, 4 Drawing Sheets

ELECTRICAL END TERMINAL FOR USE WITH NO TOOL CONNECTOR

REFERENCE TO RELATED APPLICATION

The present application is based on provisional Application No. 60/131,343 filed Apr. 28, 1999 entitled ELECTRICAL END TERMINAL WITH NO TOOL CONNECTOR.

BACKGROUND AND BRIEF DESCRIPTION OF THE INVENTION

This invention is an improvement on the QUICK MULTIPLE CONNECT ELECTRICAL CONNECTOR disclosed in Swenson Patent No. 5,695,369 and Swenson Patent No. 5,228,875. In the above referenced Swenson patents, a connection chamber has mounted therein a shaped surface projecting into the connection chamber and a threaded surface associated therewith. A coacting clamping member is associated with the connection chamber, each clamping member has a threaded portion which is threadably engageable with the threaded surface of the connection chamber and has a complementary tapered surface which is complementary to the tapered surface in the conductive member. Stranded conductive wires are passed through the hollow clamping member and splayed on the conical or taper-shaped end surface of the metal conductor. The relative rotation between the housing member and the clamping member causes the threads to reduce the distance between the complementary surfaces and clamp the bare ends of the splayed wire between the conical surfaces.

According to the present invention, a conductive end terminal having an end portion which is integrally formed therewith adapted to be inserted into one of the hollow clamping members and having a splayable end fingers for splaying by the taper-shaped surfaces on the conductive element whereby the relative rotation of the hollow clamping member and the insulated housing member with each other causes the threaded portions to reduce the gap between the tapered portion and the complementary tapered surface portion to securely clamp the splayable end of the conductive end terminal to the conductive member thereby making a secure electrical connection therewith. The splayable end fingers are preferably shaped to engage one of said conical surfaces so as to preclude the splayable ends backing out as the gap between tapered surface portions is reduced. To the same end, a notch or barb is formed on the shank of the terminal end to engage the wall of the hollow male clamping member. Thus, the invention provides the securement of a terminal end without use of tools of any kind and which may be reusable and which is relatively low in cost.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
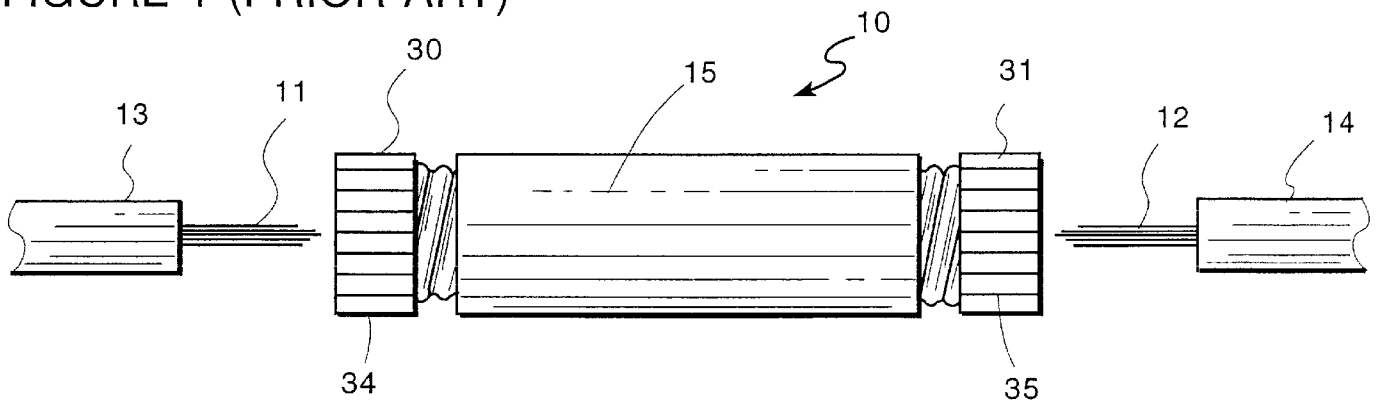
FIGURE 1 (PRIOR ART)
FIG. 1 is an external view of the connector type disclosed in the above referenced Swenson patents.
Figure 2:
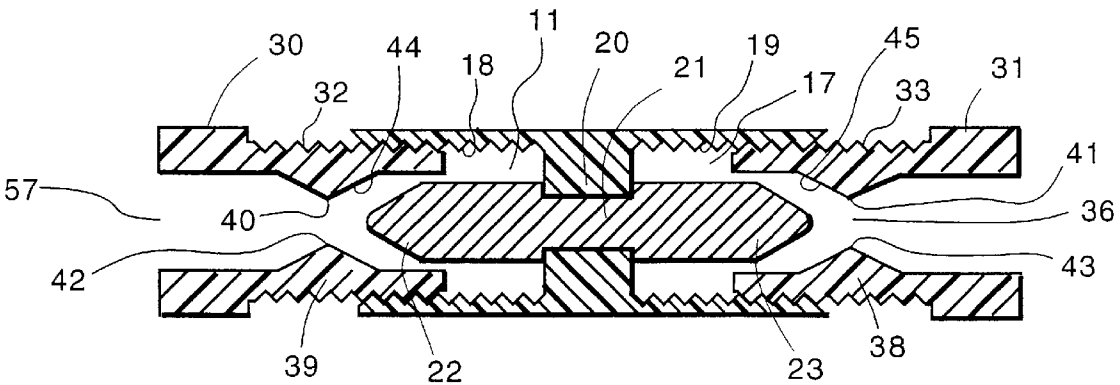
FIGURE 2 (PRIOR ART)
FIG. 2 is a sectional view of the device shown in FIG. 1.

Referring to FIG. 1, an electrical connector 10 for connecting the bare ends of wires 11, 12 of the pair of wires 13, 14, respectively. As disclosed in Swenson Patent Nos. 5,695,369 and 5,868,589, it includes a non-conductive first coupling member 15 which may be circular, square, triangular or any other configuration. It may include thumb wings to provide additional torque (see FIG. 10). Non-conductive coupling member 15 forms a housing for connection chambers 16 and 17 (see FIG. 2). Each of the connection chambers has internally threaded walls 18 and 19, respectively, and a partition member 20 which mounts or secures a common metal connector member 21. The metal connector member 21 is fixedly mounted in partition 20 by being molded in, or glued in, or otherwise fixed in place. Common metal connector member 21 has a pair of tapered, bullet-shaped or conically-shaped projections 22, 23, respectively, which project into connection chamber 16 and 17, respectively.

Figure 3:
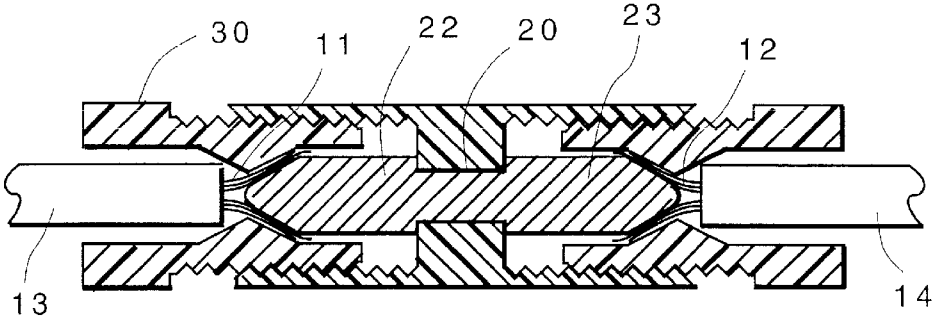
FIGURE 3 (PRIOR ART)
FIG. 3 is a sectional view of the connector of FIG. 1 with two wires coupled together thereby.
Figure 5:
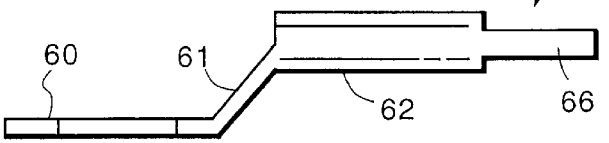
FIG. 5 is a side elevational view of the terminal end shown in FIG. 4.

A pair of non-conductive second coupling members 30 and 31 have externally threaded walls 32 and 33, respectively, and knurlated external surfaces for finger grasp members 34, 35, respectively. Thumb wings may be added to enhance the torque. The externally threaded walls 32 and 33 are threadably engaged with internally threaded bores 18 and 19, respectively. Each of the non-conductive second coupling members 30 and 31 have a throughbore 36, 37, respectively, with an inwardly projecting member 38, 39. A first conical surface 40, 41 has an apex end 42, 43 constituting the narrow portion of the throughbore. The conical surfaces 40, 41 serve the function of guiding the loose wire strands to the apex end and thence upon the bullet ends 22, 23 of metal connector member 21. The opposite side of the apex end 43 includes a second conical surface 44, 45, respectively, which coact with the bullet or conically-shaped ends 22, 23 to form a clamp space in which the bare wire ends 11 and 12 are splayed and guided by the bullet-shaped ends 22, 23 of connection member 21. The apex end prevents the wire insulation from being jammed into the space between a first and second conically-shaped surface. Thus, when the bare wire ends of the electrical wires are inserted into the second end of the throughbore in the second coupling members, the bare wire end is guided off the central axis by the bullet-shaped end surface to be positioned between the conically-shaped surfaces. When the user grasps the members 34, 35 and rotates them in a direction to cause the coupling members 30 and 31 to move inwardly, the bare wire ends 11 and 12 are tightly gripped or clamped between the conically-shaped surfaces 44, 45 and the bullet-shaped ends, respectively. The wires 11 and 12 can be clamped simultaneously or separately. Knurlations may also be formed on the housing member 15. FIG. 3 shows the wire ends clamped in position in accordance with the invention.

THE PRESENT INVENTION

Referring now to FIGS. 4–12, the technique for clamping bare wire ends is identical to that described earlier and need not be repeated.

Figure 4:
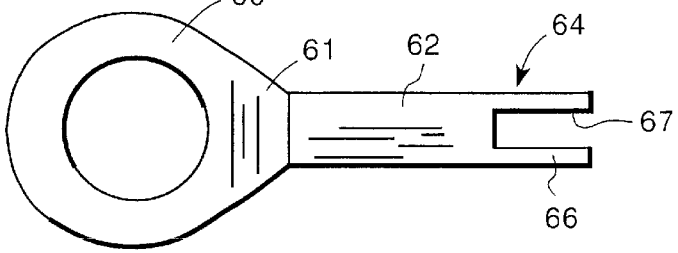
FIG. 4 is a top plan view of a terminal end incorporating the invention.
Figure 6:
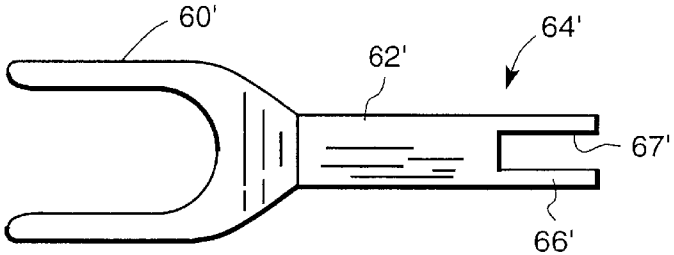
FIG. 6 is a top plan view of a further embodiment.
Figure 11:
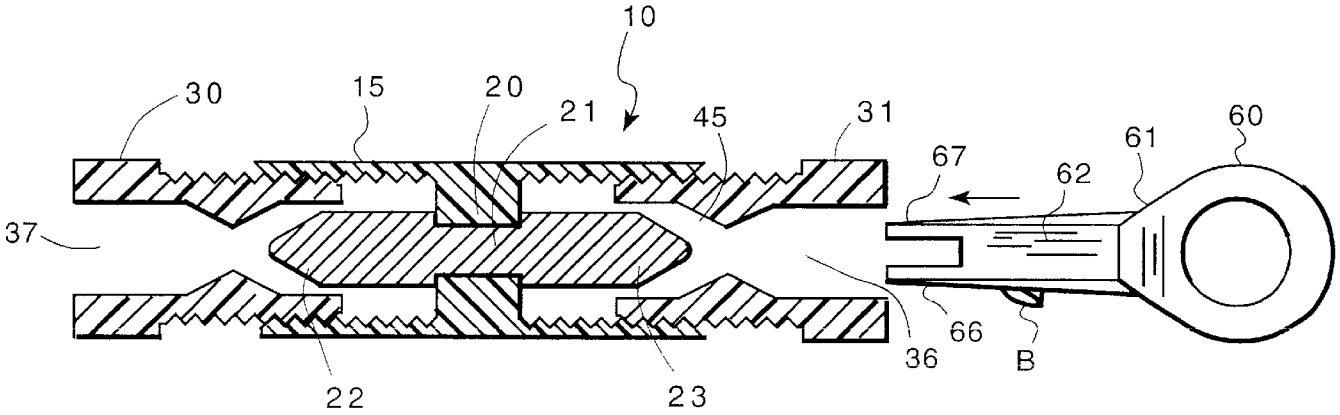
FIG. 11 shows a connector of the type illustrated in FIGS. 1–3 about to receive a terminal end according to the invention.
Figure 12:
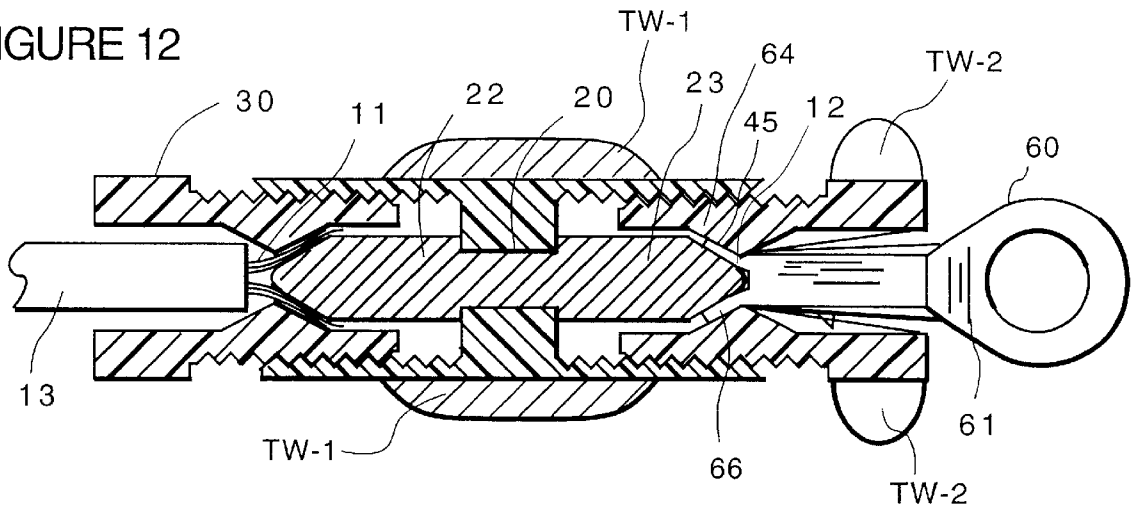
FIG. 12 shows the connector with a stranded wire secured in one end and a terminal end secured in the opposite end.

FIG. 4 shows an integral terminal end made of malleable copper or other conductive metal having a closed loop, ring or eyelet 60 with a coupler portion 61 leading to a tubular shank portion 62 and a splayable end portion 64. Splayable end portion 64 has a plurality of outwardly deflectable or splayable fingers 66, 67 which, when inserted into throughbore 36 as indicated in FIG. 11, passes through the throughbore to engage projection 23 and fingers 66, 67 are deflected or splayed outwardly and shaped by the tapered conical surface 23. Then relative rotation by hand of housing member 15 and second coupling member 31 securely clamps the splayed end 64 between surfaces 23 and conical surface 45 as shown in FIG. 11.

Figure 9B:
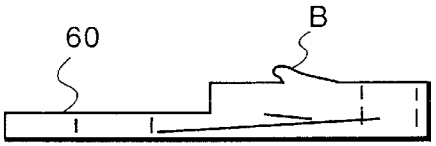
FIG. 9B is a side view thereof.
Figure 10B:
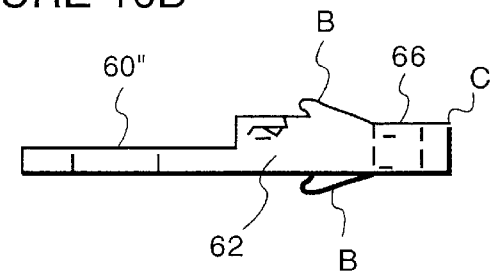
FIG. 10B is a side view thereof.
Figure 9A:
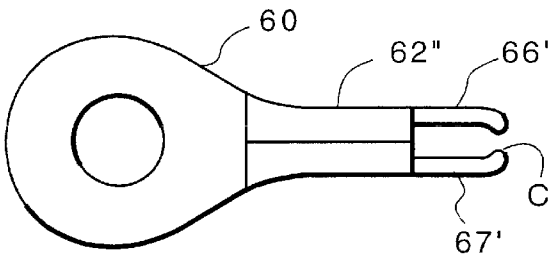
FIG. 9A is a top plan view of a further embodiment.

As shown in FIGS. 9A and 10B, the splayable members or fingers can have end claw formations "C" which are turned inwardly (FIG. 9A) to engage bullet member 23 or outwardly (FIG. 10A) to engage conical surface 45 to prevent the splayed ends from backing out of the male member as the gap between conical surfaces is reduced. In addition, one or more barbs or notches B" may be formed on the shank 62 which are for the purpose of engaging the walls of the throughbore portion to impede undesired longitudinal movement of the end terminal relative to the male member as the gap is reduced.

In these embodiments, the shank 62" is conical as is the throughbore portion 36' (see FIG. 9).

A wire end 13 is shown as being connected on the opposite side of the connector 10.

Figure 10A:
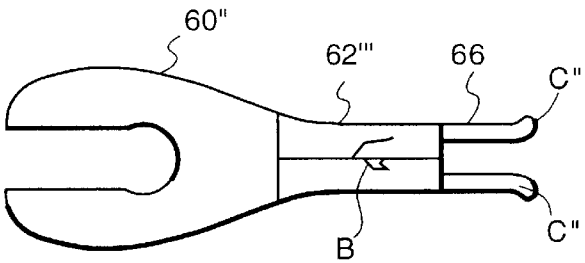
FIG. 10A is a top plan view of a further embodiment.

FIG. 10A shows a fork- or spade-type terminal end 60'.

Figure 8:
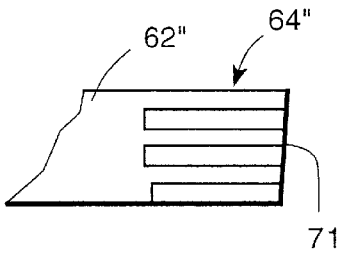
FIG. 8 is a partial view of a further embodiment of the splayable end of the terminal end.

In FIG. 8 an annular ring of fingers 71 is illustrated as comprising the splayable end 64".

Figure 7:
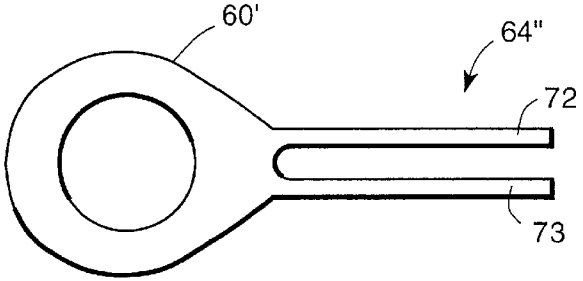
FIG. 7 is a top plan view of a further embodiment.

The terminal end can be flat as shown in FIG. 7. The splayable end 64" comprises fingers 72, 73. Instead of being a flat copper terminal end the fingers 72, 73 can be made wider and given a 90° twist. Instead of being made from copper, the conductive portion can be made of other conductive materials so long as the splayable ends are present and can be clamped between conical surfaces 23 and 45 as shown in FIG. 10. To enhance the torque exerted by the manual finger rotation between body member 15 and coupling member 31, thumb wings TW can be molded on the body member 15 and thumb wings TW-2 on the coupling member.

The invention may also be used with the fuseholder connector shown in Swenson Patent No. 5,868,589.

While preferred embodiments of the invention have been described and illustrated, it will be appreciated that other embodiments and adaptations and changes to the invention will be readily apparent to those skilled in the art.

What is claimed is:

1. A no-tool system for connecting an insulated wire to a conductive end terminal, comprising:

an insulated housing member having a pair of connection chambers and a conductive element extending between both chambers and having a taper-shaped surface projecting into each connection chamber, each connection chamber having a threaded surface associated therewith, a hollow clamping member for each connection chamber, each hollow clamping member having a threaded portion which is threadably engageable with the threaded surface associated therewith, and a complementary tapered surface which is complementary to said taper-shaped surface, said conductive end terminal having an integrally formed splayable end adapted to be inserted into one of said hollow clamping members, said splayable end being splayed by said taper-shaped surface on said conductive element in one of said connection chambers, whereby, relative rotation by hand of said hollow clamping member and said insulated housing member with said threaded surface and threaded portions threadably engaged, said splayable end is securely clamped between said tapered-shaped surface and said complementary tapered surface and a bare wire end on said insulated wire is inserted into the other of said hollow clamping members such that said bare wire end is splayed on said conductive element in the other of said connection chambers and clamped therein by relative rotation by hand of a second of said clamping members and said insulated housing member.

2. A conductive end terminal for use with a no tool electrical connector, said no tool electrical connector having a housing part with a connection chamber and a conductive, shaped splaying member fixed in said housing, said splaying member having a shaped splaying surface, a threaded surface on said housing member, a hollow clamping member having a threaded surface threadably engageable with said threaded surface on said housing member and a shaped surface complementary to said shaped splaying surface, said conductive end terminal having an integrally formed splayable end adapted to be inserted into said hollow clamping member, said splayable end being splayed outwardly by said splaying member on said shaped splaying surface, whereby, relative rotation by hand of said hollow clamping member and said insulated housing member with said threaded surface and threaded portions threadably engaged, said splayable end is securely clamped between said shaped splaying surface and said complementary shaped surface.

3. The conductive end terminal defined in claim 2 wherein said conductive end terminal has a rigid shank portion and said splayable end is on said shank portion.

4. The conductive end terminal defined in claim 3 wherein said rigid shank portion has one or more barbs adapted to engage said hollow clamping member and preclude undesired longitudinal movement of said end terminal relative to said hollow clamping member.

5. The conductive end terminal defined in claim 2 wherein said splayable end has structural formations thereon which impede undesired longitudinal movements of said end terminal relative to said hollow clamping member.

6. The conductive end terminal defined in claim 4 wherein said splayable end has structural formations thereon which impede undesired longitudinal movements of said end terminal relative to said hollow clamping member.

7. The conductive metal end terminal defined in claim 2 wherein said end terminal is made of a malleable metal.

8. A conductive end terminal for use with an electrical connector having a housing part with a connection chamber and a conductive, shaped splaying member fixed in said housing, said splaying member having a shaped splaying surface, a threaded surface on said housing member, a hollow clamping member having a threaded surface threadably engaged with said threaded surface on said housing member and a shaped surface complementary to said shaped splaying surface, said conductive end terminal having a terminal end and an integrally formed splayable end adapted to be inserted into said hollow clamping member, said splayable end being splayed outwardly on being engaged by said splaying member on said shaped splaying surface, whereby relative rotation by hand of said hollow clamping member and said insulated housing member with said threaded surface and threaded portions threadably engaged, said splaying end is securely clamped between said splaying surface and said complementary shaped surface.

9. The conductive end terminal defined in claim 8 wherein said splayable end has structural formations thereon which impede undesired longitudinal movement of said end terminal relative to said hollow clamping member during said relative rotation by hand of said hollow clamping member.

10. The conductive end terminal defined in claim 8 wherein said splayable end is secured to said terminal end by a shank portion and said shank portion have barbs formed thereon.

* * * * *